US006524194B2

(12) United States Patent
McCabe

(10) Patent No.: US 6,524,194 B2
(45) Date of Patent: Feb. 25, 2003

(54) GOLF CLUB HEAD CONSTRUCTION

(75) Inventor: Terrill R. McCabe, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 42 days.

(21) Appl. No.: 09/761,851

(22) Filed: Jan. 18, 2001

(65) Prior Publication Data

US 2002/0094880 A1 Jul. 18, 2002

(51) Int. Cl.[7] ..... A63B 53/02; A63B 53/04
(52) U.S. Cl. ..... 473/305; 473/345; 473/349
(58) Field of Search ..... 473/324, 349, 473/345, 346, 305, 306, 307, 308, 309, 310, 311, 312, 313, 314, 315, 316, 245, 246, 248, 291

(56) References Cited

U.S. PATENT DOCUMENTS

| | | | | |
|---|---|---|---|---|
| 1,968,092 | A | | 7/1934 | Oldham |
| 4,432,549 | A | * | 2/1984 | Zebelean |
| 4,438,931 | A | | 3/1984 | Motomiya |
| 4,928,965 | A | | 5/1990 | Yamaguchi et al. |
| 5,024,437 | A | | 6/1991 | Anderson |
| 5,094,383 | A | | 3/1992 | Anderson et al. |
| 5,141,230 | A | | 8/1992 | Antonious |
| 5,172,913 | A | | 12/1992 | Bouquet |
| 5,205,560 | A | | 4/1993 | Hoshi et al. |
| 5,232,224 | A | | 8/1993 | Zeider |
| 5,261,663 | A | | 11/1993 | Anderson |
| 5,344,140 | A | | 9/1994 | Anderson |
| 5,346,217 | A | | 9/1994 | Tsuchiya et al. |
| RE34,925 | E | | 5/1995 | McKeighen |
| 5,421,577 | A | | 6/1995 | Kobayashi |
| 5,429,357 | A | | 7/1995 | Kobayashi |
| 5,429,365 | A | | 7/1995 | McKeighen |
| 5,460,371 | A | | 10/1995 | Takeda |
| 5,464,216 | A | | 11/1995 | Hoshi et al. |
| 5,482,279 | A | | 1/1996 | Antonious |
| 5,485,998 | A | | 1/1996 | Kobayashi |
| 5,505,795 | A | | 4/1996 | Tsai et al. |
| 5,518,240 | A | | 5/1996 | Igarashi |
| 5,533,729 | A | | 7/1996 | Leu |
| 5,556,097 | A | | 9/1996 | Endo et al. |
| 5,665,014 | A | | 9/1997 | Sanford et al. |
| 5,704,850 | A | | 1/1998 | Shieh |
| 5,776,011 | A | | 7/1998 | Su et al. |
| 5,954,596 | A | * | 9/1999 | Noble |
| 5,961,394 | A | | 10/1999 | Minabe |
| 6,001,027 | A | * | 12/1999 | Hansberger |
| 6,071,200 | A | * | 6/2000 | Song |
| 6,325,728 | B1 | * | 12/2001 | Helmstetter |

FOREIGN PATENT DOCUMENTS

| | | |
|---|---|---|
| JP | 09-168613 | 6/1997 |

* cited by examiner

*Primary Examiner*—Sabastiano Passaniti
(74) *Attorney, Agent, or Firm*—Swidler Berlin Shereff Friedman, LLP

(57) ABSTRACT

A golf club head adapted for attachment to a shaft is provided. The head includes a first portion that forms an integral face and neck, with the neck having a keyed section. A second portion of the club head provides a body with a crown region and a sole region, the crown region including a keyway. A third portion is also provided in the form of a hosel tube with a top end being configured and dimensioned to receive the shaft. The hosel tube is received in the neck and fixed thereto. The first portion is fixed to the body to form a cavity, with the keyed section mating with the keyway.

20 Claims, 6 Drawing Sheets

GOLF CLUB HEAD CONSTRUCTION

FIELD OF THE INVENTION

The invention relates to a golf club head construction. More particularly, the invention is related to a three-piece golf club head construction including a stamped or forged face and neck, a cast body, and a hosel tube adapted to be received in the neck.

BACKGROUND OF THE INVENTION

The design and manufacture of metal wood golf clubs requires careful attention to club head construction. Among the many factors that must be considered are materials selection, materials treatment, structural integrity, and overall geometrical design. Club heads are typically formed from stainless steel, aluminum, or titanium, and are cast, stamped as by forming sheet metal with pressure, forged, or a combination of any two or more of those processes. The club heads may be formed from multiple pieces that are welded together to form a hollow head, as is often the case of club heads designed with either sole plates or crown plates. The multi-piece constructions facilitate access to the cavity formed within the club head, thereby permitting the attachment of various other components to the head such as internal weights and the club shaft. In addition, due to difficulties in manufacturing one-piece club heads to high dimensional tolerances, the use of multi-piece constructions allows the manufacture of a club head to a tight set of standards.

Various multi-piece club head constructions are known. For example, U.S. Pat. No. 5,518,240 to Igarashi discloses a metal wood club head fabricated from cast sections. The head is fabricated in two half-sections, each formed by a casting technique, with the sections being joined by welding together facing edges of the sections along a parting line.

U.S. Pat. No. 5,232,224 to Zeider discloses a golf club head and method of manufacture. The club head has a sole plate formed integrally with a heel, toe, and back wall, and has open front and upper faces across which a face plate and crown plate, respectively, are welded. The base, face plate, and crown plate are all stamped sheet metal parts. A hosel tube projects upwardly at a desired lie angle from the base through an opening in the crown plate.

Another club head construction is disclosed in U.S. Pat. No. 5,346,217 to Tsuchiya et al. The club head is formed in three pieces including a face section, a crown section, and a sole section. The pieces are united with a separate hosel.

Despite these developments, there exists a need for an improved golf club head construction. In particular, there is a need for a golf club head that can be formed from several components that may be fixed together. More particularly, there is a need for a golf club head with a thin, stamped or forged face with a neck portion that receives a hosel tube for providing enhanced structural integrity to the club head.

SUMMARY OF THE INVENTION

The present invention is related to a golf club head adapted for attachment to a shaft. The head includes a first portion forming a face and neck. The neck has a keyed section. The head also includes a second portion forming a body with a crown region and a sole region, the crown region including a keyway. In addition, the head includes a third portion forming a hosel tube that has a top end which is configured and dimensioned for receiving the shaft, as well as a bottom end. The hosel tube is received in the neck and fixed thereto, and the first portion is fixed to the body to form a cavity. The keyed section mates with the keyway. The first portion may be forged or stamped and the second portion may be cast, or both the first and second portions may be cast.

In one embodiment, the sole region includes a hole therein, with the hole being configured and dimensioned to receive the hosel tube. The hosel tube has an upper portion, a lower portion, and a shoulder portion extending therebetween. When fully inserted in the neck of the first portion, the shoulder portion abuts the top surface of the neck. The hosel tube has an upper portion with an outer diameter that is greater than the outer diameter of its lower portion, and may further include a top end and a bottom end, with the bottom end being disposed generally coplanar with the sole region adjacent the hole. The hosel tube has a central axis and the lie angle of the club head is between about 40° and about 70° with respect to the central axis. The second portion may include more than one piece secured together.

The hosel tube may be coupled directly to both the neck of the first portion and the sole region of the second portion, as by welding. The hosel tube may be provided with a through-bore or a blind bore.

The face of the golf club head has an exterior surface and an interior surface, and the interior surface is provided with a centrally thickened region formed thereon and having a thickness of between about 0.06 inch and 0.18 inch. The regions of the face adjacent the centrally thickened region may also be provided with a thickness of between about 0.06 inch and 0.12 inch.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

Figure 1:
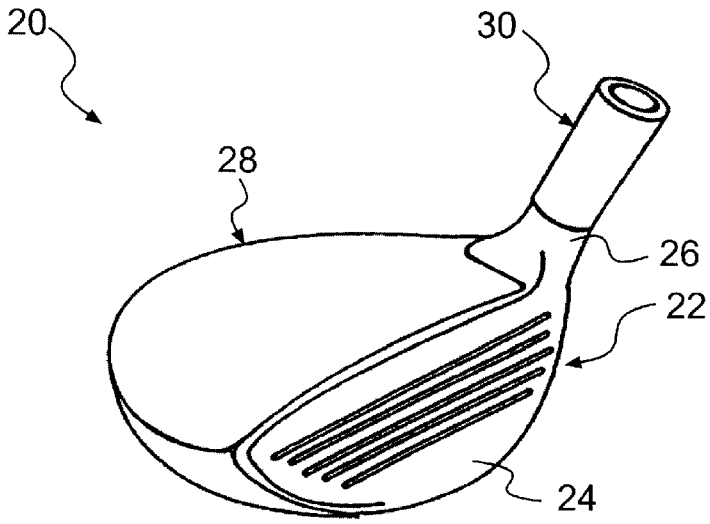
FIG. 1 shows a perspective view of a golf club head of the present invention.
Figure 2:
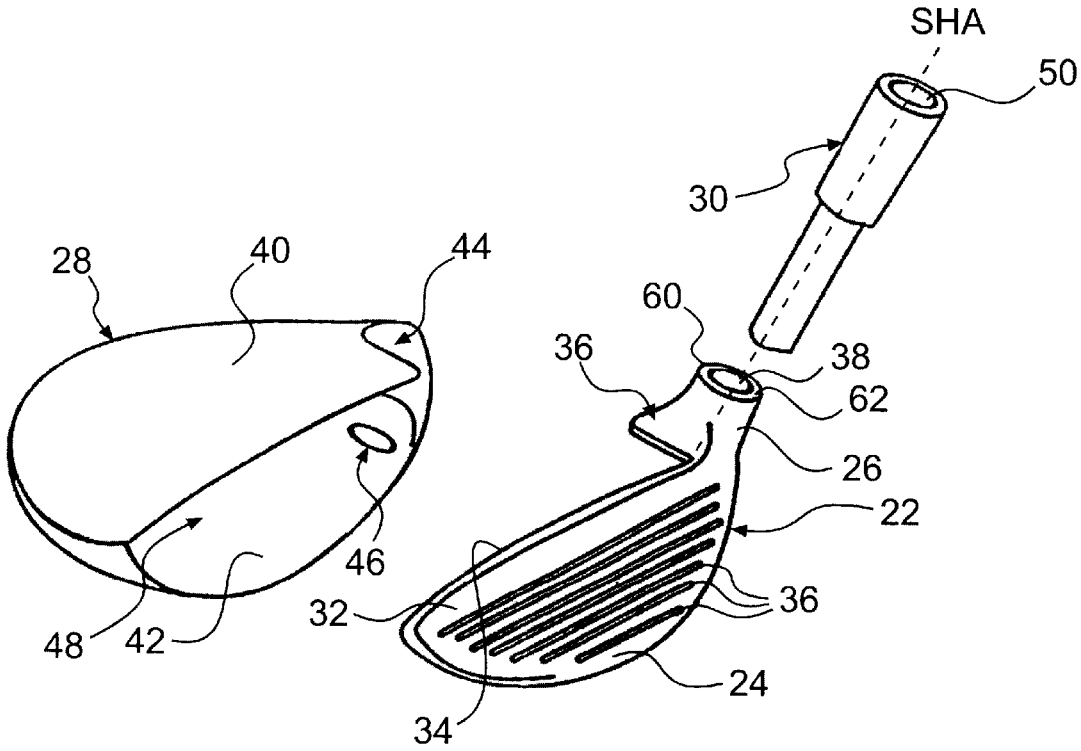
FIG. 2 shows an exploded view of the golf club head of FIG. 1.

Referring to FIGS. 1–11, a golf club head construction according to the present development is shown. With reference to FIGS. 1–2, golf club head 20 includes a first portion 22 with integral face 24 and neck 26, a second portion forming a body 28, and a hosel tube 30. Face 24 has a exterior, ball-striking surface 32 and an interior surface 34. Exterior surface 32 preferably has grooving 36. Neck 26 extends from face 24 and includes a keyed portion 36 and a through-bore 38. First portion 22 is adapted to be attached to body 28. Preferably, body 28 includes a crown region 40, a sole region 42, and a keyway 44. A hole 46 may also be provided in sole region 42, the purpose of which will be explained shortly. When first portion 22 and body 28 are fixed to each other, as by welding, keyed portion 36 of neck 26 mates with keyway 44 of body 28. Preferably, keyed portion 36 and keyway 44 each include straight portions that mate together, although other geometries may be used. An inner cavity 48 also is formed in body 28 and enclosed when first portion 22 is fixed thereto. Cavity 48 may be empty, or alternatively may be filled with a foam or other low specific gravity material. Hosel tube 30 includes a bore 50 therein for receiving a golf club shaft. Preferably, first portion 22 is stamped or forged, while body 28 is cast. In an alternate embodiment, first portion 22 and body portion 28 are both cast. Also, in another alternate embodiment, body 28 may be formed of more than one piece, as for example by having separate portions for the skirt, crown, and sole. Preferably, hosel tube 30 is machined from titanium tubing.

Golf club head 20 is preferably formed of metal such as titanium. In the preferred embodiment, first portion 22 is forged from a high strength forging titanium alloy such as 10-2-3 (Ti-10% V-2% Fe-3% Al) or 15-3-3-3 (Ti-15% V-3% Cr-3% Sn-3% Al), or stamped from as-rolled sheet stock. Alternatively, first portion 22 may be formed. Body 28 may be produced from a different titanium alloy from that of face 16, preferably by casting a 6-4 alloy (Ti-6% Al-4% V). In alternate embodiments, other forging and casting alloys may be used such as stainless steel and aluminum. By forming first portion 22 by stamping or forging, first portion 22 may be thin yet still have sufficient strength to withstand repeated impact with a golf ball without failure. In turn, by forming face 24 as thin as possible while still meeting the desired mechanical performance standards, weight may be redistributed to other parts of club head 20.

Figure 3:
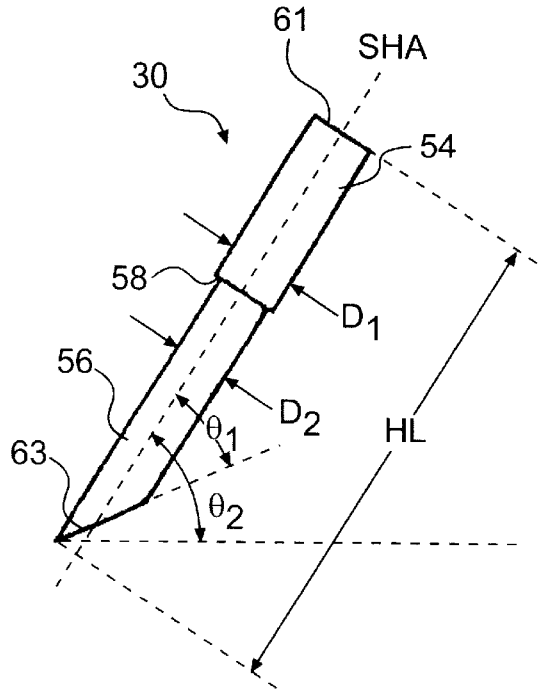
FIG. 3 shows a side view of the hosel tube of FIG. 1.

As shown in FIG. 3, hosel tube 30 includes a generally cylindrical upper portion 54 with an outer diameter $D_1$ , a generally cylindrical lower portion 56 with an outer diameter $D_2$, and a shoulder portion 58 therebetween Preferably, outer diameter $D_1$ is larger than outer diameter $D_2$. Outer diameter $D_2$ is sized to be accommodated in through-bore 38 of neck 26, while outer diameter $D_1$ is sized to closely match the dimensions of the top periphery 60 of neck 26. Thus, when hosel tube 30 is fully inserted into through-bore 38, shoulder portion 58 rests on top surface 62 of neck 26, and bottom edge 63 of hosel tube 30 is received in hole 46 in the sole region 42 of body 28. Once positioned in hole 46, hosel tube 30 is welded are otherwise fixed thereto. Preferably the overall length HL of hosel tube 30 is between about 3.5 inches and 3.8 inches, and more preferably 3.65 inches.

Hosel tube 30 is disposed about a central axis SHA. In the preferred embodiment, bottom edge 63 of hosel tube 30 is disposed at an angle $\theta_1$, with respect to central axis SHA. The club also has a lie angle $\theta_2$, which is the angle formed between the club's shaft axis, coinciding with central axis SHA of hosel tube 30, and the bottom of the club head. Preferably, lie angle $\theta_2$ is between about 40° and about 70°. Preferably, angle $\theta_1$ is about lie angle $\theta_2$ minus the curvature of the sole, and more preferably, angle $\theta_1$ is between about 20° and about 50°.

Figure 3A:
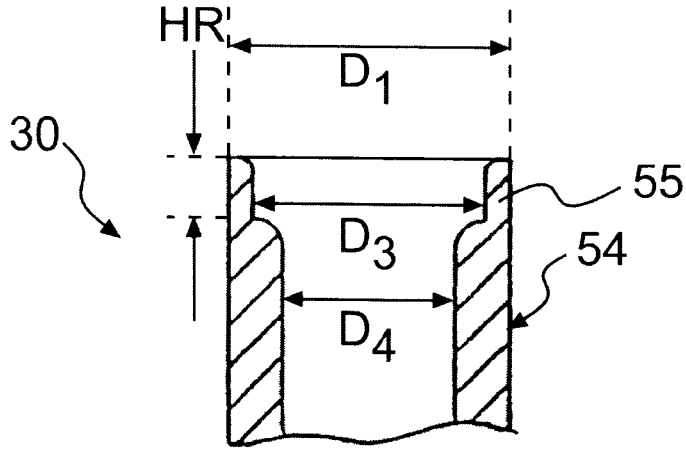
FIG. 3A shows a side, cross-sectional view of the upper portion of the hosel tube of FIG. 3.
Figure 3B:
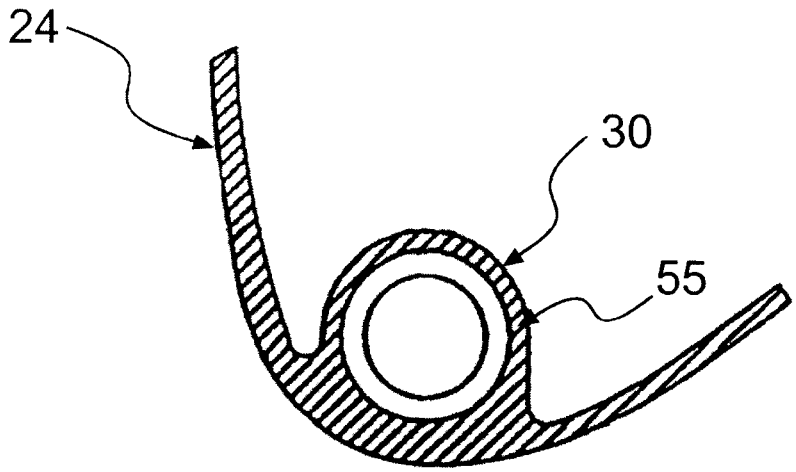
FIG. 3B shows a top, partial cross-sectional view of the hosel tube of FIG. 3.

As shown in FIGS. 3A and 3B, upper portion 54 of hosel tube 30 preferably includes an uppermost internal rim portion 55 with a diameter $D_3$ that is greater than the diameter $D_4$ of the remainder of upper portion 54. In the preferred embodiment, outer diameter $D_1$ of hosel tube 30 is between about 0.47 inch and about 0.50 inch, and outer diameter $D_2$ is between about 0.39 inch and 0.41 inch. Diameter $D_3$ of internal rim portion 55 is between about 0.37 inch and about 0.43 inch, while diameter $D_4$ is between about 0.32 inch and 0.36 inch. Internal rim portion 55 preferably has a rim height HR of between about 0.10 inch and about 0.16 inch, and more preferably about 0.13 inch. Preferably, in regions other than internal rim portion 55, the wall thickness of hosel tube 30 is greater than or equal to about 0.05 inch.

Figure 4:
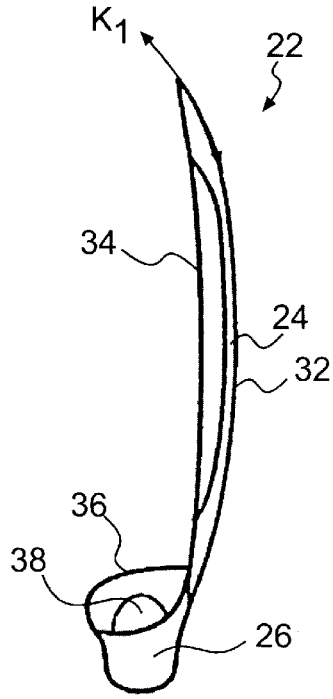
FIG. 4 shows a bottom view of the face and neck portion of the golf club head of FIG. 1.
Figure 5:
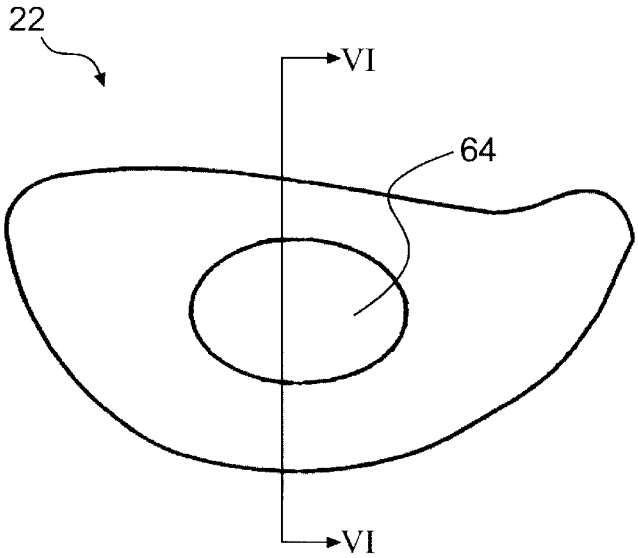
FIG. 5 shows a front view of the face of the golf club head of FIG. 1.
Figure 6:
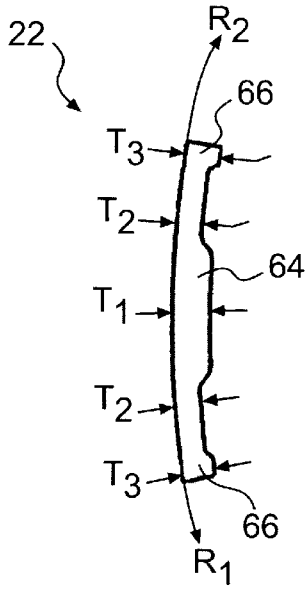
FIG. 6 shows a cross-sectional view of the golf club head taken along line VI—VI of FIG. 5.

Referring to FIGS. 4–6, face 24 of first portion 22 preferably has bulge and roll radii $R_1$ and $R_2$, respectively, of about 10.5 inches each. In the preferred embodiment, face 24 has variable thicknesses. Preferably, a centrally thickened region 64 is provided, and may be generally in the shape of an ellipse. Cross-section VI—VI of face 24 is shown in FIG. 6. Thickened region 64 preferably is provided with a thickness $T_1$ of between about 0.06 inch and 0.18 inch, and adjacent to thickened region 64, face 24 preferably has a thickness $T_2$ between about 0.06 inch and 0.12 inch. Outer regions 66 of face 24 preferably have a thickness $T_3$ between about 0.06 inch and 0.18 inch. Thickness $T_1$ is greater than thickness $T_2$. In an alternate embodiment, face 22 has a constant thickness.

Figure 7:
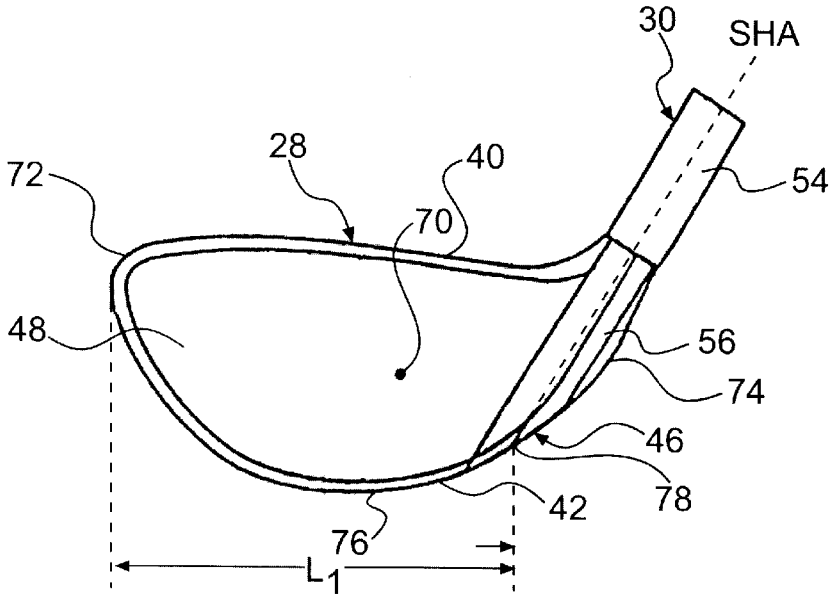
FIG. 7 shows a front, partial cross-sectional view of the golf club head of FIG. 1.

As shown in FIG. 7, in the preferred embodiment hosel tube 30 preferably extends to hole 46 in sole region 42 of body 28. Preferably, hosel tube 30 includes a bore 50 that extends from top face 61 to bottom edge 63. The provision of a through-bore 50 permits the weight of hosel tube 30 to be minimized, yet still providing the needed structural integrity for the attachment of a club shaft to the head. In alternate embodiments, hosel tube 30 is provided with a blind bore that extends at least within part of upper portion 54 from top face 61.

Advantageously, the center of gravity 70 of club head 20 is located such that club head 20 is balanced and has desirable feel and performance. Club head 20 has a toe 72, a heel 74, and a lowermost point 76. When bottom edge 63 of hosel tube 30 is in hole 46 and flush with sole region 42, bottom edge 63 has a center point 78, at the center of hosel tube 30, which is spaced a horizontal distance $L_1$ from toe 72. In one embodiment, horizontal distance $L_1$ is between about 0.8 inch and about 1.1 inch. In addition, center of gravity 70 is disposed behind face 24, and closer heel 74 than toe 72.

Figure 8:
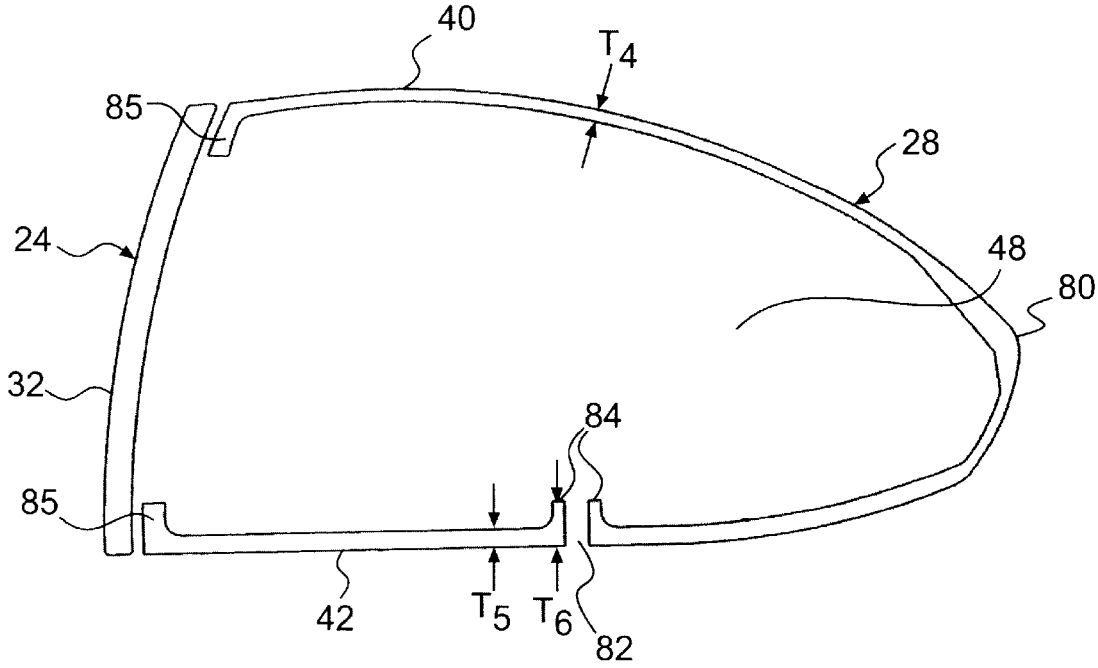
FIG. 8 shows a cross-sectional view of the face and body of the golf club head of FIG. 1.

Turning to FIG. 8, body 28 preferably forms a shell of variable thickness. In particular, the thickness $T_4$ in crown region 40 is greater than the thickness $T_5$ in sole region 42. In addition, the rear 80 of body 28 may be greater in thickness than either crown region 40 or sole region 42. A vent hole 82 may also be provided in sole region 42 to permit venting during welding of portions of club head 20. In addition, vent hole 82 may be used for access to cavity 48, as may be necessary for the delivery of foam or other filler material thereto. In the preferred embodiment, vent hole 82 includes a lip portion 84. Vent hole 82 preferably creates an opening with an internal diameter of between about 0.10 inch and 0.40 inch, and more preferably about 0.25 inch. Preferably, lip 84 provides a portion of sole region 42 with an increased thickness $T_6$ of between about 0.1 inch and 0.2 inch, and more preferably about 0.15 inch. An additional lip 85 may be provided on body 28 for abutting face 24, which preferably follows the variable thickness profile shown in FIG. 6.

Figure 9:
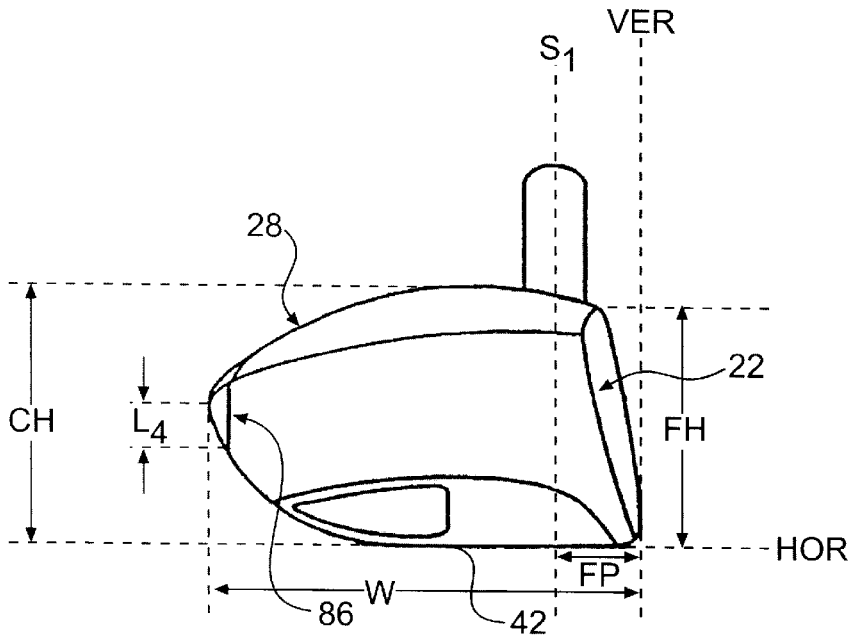
FIG. 9 shows a side view of the golf club head of FIG. 1.
Figure 10:
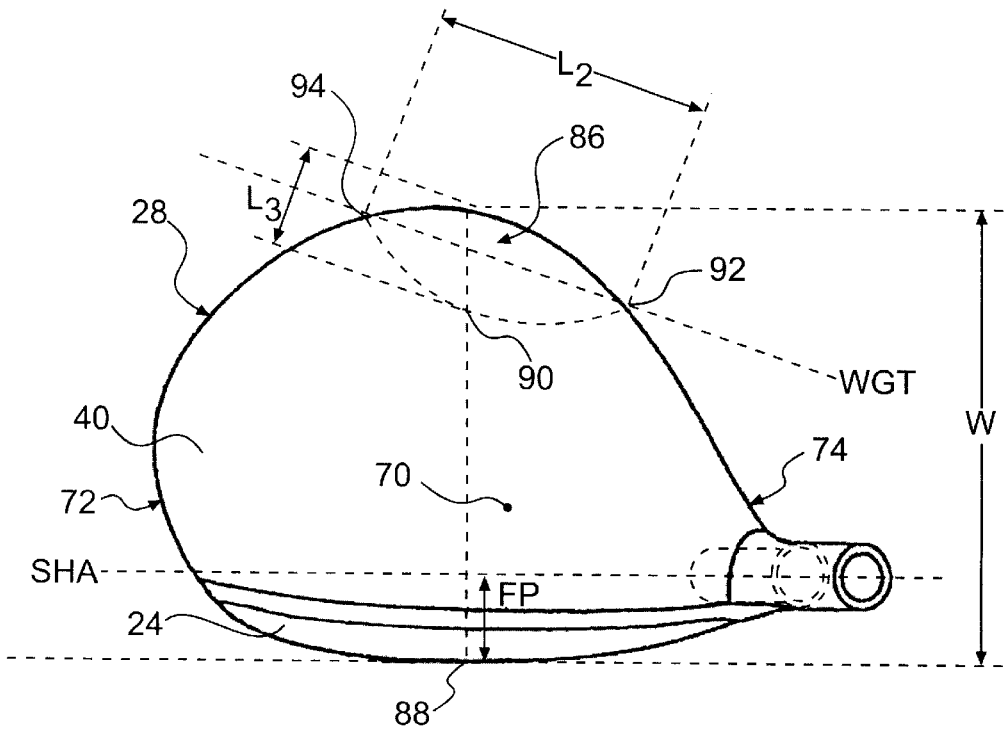
FIG. 10 shows a top, partial cross-sectional view of the golf club head of FIG. 1.

With particular reference to FIGS. 9–10, a backweight 86 is shown. Preferably, backweight 86 is located in the heel-to-toe, horizontal direction as close to face center point 88 as possible, as shown by the alignment of face center point 88, located at the frontmost portion of the club face, and midpoint 90 of backweight 86. In addition, the maximum length $L_2$ of backweight 86 preferably is between about 2.2 inches and about 2.5 inches, while the maximum width $L_3$ of backweight 86 preferably is between about 0.4 inch and about 0.6 inch. Backweight 86 is installed at an angle of about 4° to about 6° open to face 24, as generally represented by alignment line WGT which passes through points 92, 94 that are located at the maximum linear separation on backweight 86. In one embodiment, backweight 86 extends no lower than a vertical distance $L_4$ of about 0.25 inch from the rearmost point of club head 20.

As shown in FIGS. 9 and 10, the face progression FP is the distance from the shaft axis SHA to the farthest front portion of club face 22 at its center point 88. The face progression FP is preferably between about 0.6 inch and 0.8 inch, and more preferably about 0.7 inch. The overall width W of club head 20 is the distance from the frontmost portion of club face 24 to the rearmost point of club head 20. Preferably, width W is between about 3.3 inches and about 3.9 inches, and more preferably about 3.6 inches.

In the preferred embodiment, club head 20 has an overall crown height CH, as measured from the highest point of crown region 40 to the lowest point of sole region 42, of between about 2.0 inches and 2.4 inches, and more preferably about 2.2 inches. The loft $\theta_2$ of club head 20, defined as the angle of face 24 to a line VER perpendicular to the sole of the club on line HOR, preferably is between about 7° and about 10° , and more preferably is about 8.5°.

Figure 11:
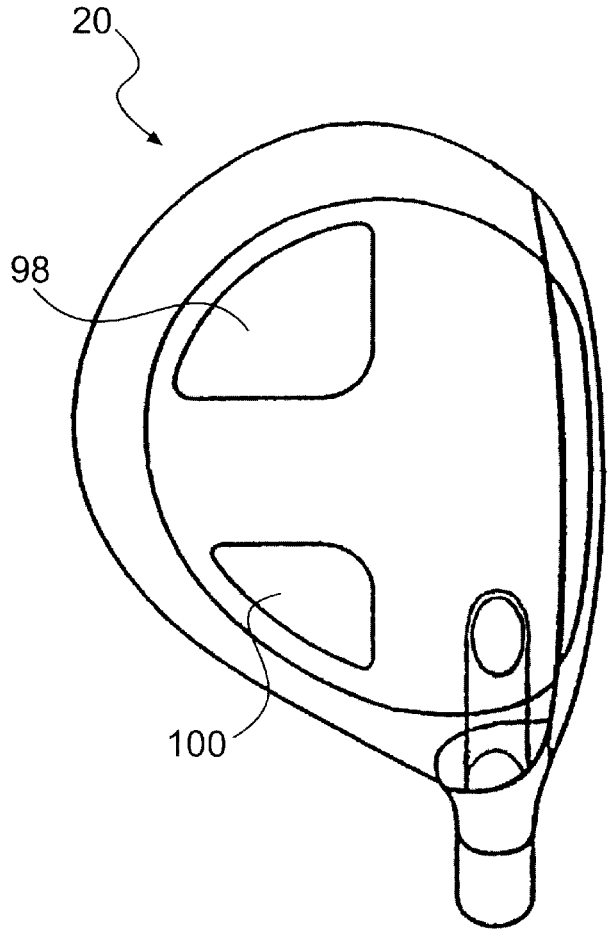
FIG. 11 shows a bottom, partial cross-sectional view of the golf club head of FIG. 1.

As shown in FIG. 11, depressions 98, 100 may also be provided in sole region 42. Preferably, depressions 98, 100 are between about 0.6 inch and about 0.8 inch deep, and more preferably about 0.7 inch deep.

The provision of a hosel tube 30 that is received in a first portion 22, including integral face 24 and neck 26, provides a club head 20 with good mechanical integrity and concomitant strength. Advantageously, stresses generated by a golf ball impact with face 24 are borne, in part, by hosel tube 30. Furthermore, the extension of hosel tube 30 to sole region 42 of body 28 provides enhanced mechanical integrity to golf club head 20.

Figure 12:
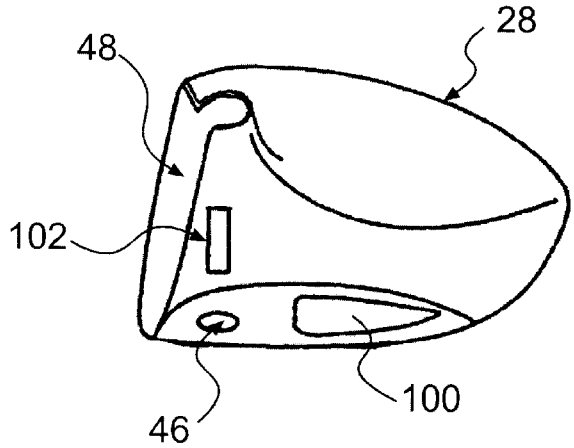
FIG. 12 shows a perspective view of the golf club head of FIG. 1.

With reference to FIG. 12, body 28 may be provided with one or more windows 102 to provide access to cavity 48 during manufacture of golf club head 20. In particular, in order to permit welding or other securement of hosel tube 30 to body 28 and/or first portion 22, windows 102 are preferably provided in general proximity to hole 46 near the location of securement of first portion 22 to body 28. Opposing holes may be provided near the toe 72 and heel 74 to allow access to cavity 48 from opposite directions.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. For example, in an alternate embodiment, hosel tube 30 may only extend to a point intermediate crown region 40 and sole region 42. Hosel tube 30 may be received by a protrusion extending from sole region 42 toward neck 26, or extending from a region of body 28 that also is intermediate crown region 40 and sole region 42. An elongate, planar, internal rib may be provided on body 28, intermediate crown region 40 and sole region 42, and hosel tube 30 may be received thereon. In addition, hosel tube 30 used in the present invention need not be a circular, cylindrical geometry, but instead may conform to other arcuate cross-sections such as oval shapes, and may be rectangular or other straight-sided geometries as well. Furthermore, although the embodiment described herein does not include a separate crown plate or sole plate, one or both may be provided for use with the present invention. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A golf club head adapted for attachment to a shaft, the head comprising;

a first portion forming a face and neck with the neck including a keyed section;

a second portion forming a body with a crown region and a sole region, the crown region including a keyway; and a third portion forming a hosel tube having a top end being configured and dimensioned for receiving the shaft, and a bottom end, wherein the hosel tube is received in the neck and fixed thereto, and the first portion is fixed to the body to form a cavity, with the keyed section mating with the keyway, and wherein the sole region includes a hole therein, the hole being configured and dimensioned to receive the hosel tube.

2. The golf club head of claim 1, wherein the first portion is forged or stamped and the second portion is cast.

3. The golf club head of claim 1, wherein the first portion and the second portion are cast.

4. The golf club head of claim 1, wherein the hosel tube has an upper portion, a lower portion, and a shoulder portion extending therebetween, the shoulder portion abutting a top surface of the neck of the first portion.

5. The golf club head of claim 4, wherein the outer diameter of the upper portion is greater than the outer diameter of the lower portion.

6. The golf club head of claim 5, wherein the hosel tube further includes a top end and a bottom end, the bottom end being disposed generally coplanar with the sole region adjacent the hole.

7. The golf club head of claim 5, wherein the hosel tube has a central axis and the lie angle of the club head is between about 40° and about 70° with respect to the central axis.

8. The golf club head of claim 1, wherein the second portion comprises more than one piece secured together.

9. The golf club head of claim 1, wherein the hosel tube is coupled directly to the neck of the first portion and the sole region of the second portion.

10. The golf club head of claim 9, wherein the hosel tube is welded to the neck and sole region.

11. The golf club head of claim 1, wherein the hosel tube has a through-bore.

12. The golf club head of claim 1, wherein the hosel tube has a blind bore.

13. The golf club head of claim 1, wherein the face has an exterior surface and an interior surface, the interior surface having a centrally thickened region formed thereon.

14. The golf club head of claim 13, wherein the centrally thickened region has a thickness of between about 0.06 inch and 0.18 inch.

15. The golf club head of claim 13, wherein the regions of the face adjacent the centrally thickened region have a thickness of between about 0.06 inch and 0.12 inch.

16. The golf club of claim 1, wherein the second portion further includes a window.

17. A golf club head adapted for attachment to a shaft, the head comprising;

a first portion forming a face and neck with the neck including a keyed section;

a second portion forming a body with a crown region and a sole region, the crown region including a keyway; and a third portion forming a hosel tube having a top end being configured and dimensioned for receiving the shaft, and a bottom end, wherein the hosel tube is received in the neck and fixed thereto, and the first portion is fixed to the body to form a cavity, with the keyed section mating with the keyway, and wherein the hosel tube has a through-bore.

18. The golf club of claim 17, wherein the first portion is forged or stamped and the second portion is cast.

19. The golf club of claim 17, wherein the second portion comprises more than one piece secured together.

20. The golf club of claim 17, wherein the hosel tube is coupled directly to the neck of the first portion and the sole region of the second portion.

* * * * *